US007462249B2

(12) United States Patent
Ding et al.

(10) Patent No.: US 7,462,249 B2
(45) Date of Patent: Dec. 9, 2008

(54) SURFACE TREATMENT PROCESS FOR METAL ARTICLES

(75) Inventors: Jiang-Rong Ding, Shenzhen (CN); Zheng-Jiang Ren, Shenzhen (CN); Hong-Hai Xu, Shenzhen (CN)

(73) Assignees: Shenzhen Futaihong Precision Industry Co., Ltd., ShenZhen, Guangdong Province (CN); Sutech Trading Limited, Tortola (VG)

( * ) Notice: Subject to any disclaimer, the term of this patent is extended or adjusted under 35 U.S.C. 154(b) by 0 days.

(21) Appl. No.: 11/847,292

(22) Filed: Aug. 29, 2007

(65) Prior Publication Data

US 2008/0185020 A1 Aug. 7, 2008

(30) Foreign Application Priority Data

Feb. 2, 2007 (CN) ..... 2007 1 0073195

(51) Int. Cl.
*B08B 3/02* (2006.01)

(52) U.S. Cl. ..... 134/26; 134/1; 134/2; 134/3; 134/28; 134/29; 134/34; 134/36; 134/40; 134/41; 134/42; 510/254; 510/255; 510/375; 510/424; 510/469; 510/506

(58) Field of Classification Search ..... 134/1–3, 134/26, 28, 29, 34, 36, 40–42; 510/254, 510/255, 375, 424, 469, 506
See application file for complete search history.

(56) References Cited

U.S. PATENT DOCUMENTS

| | | | | |
|---|---|---|---|---|
| 3,295,917 | A * | 1/1967 | Cotton | 427/248.1 |
| 3,653,931 | A * | 4/1972 | Borchert et al. | 106/3 |
| 3,714,066 | A * | 1/1973 | King et al. | 252/389.23 |
| 5,960,251 | A * | 9/1999 | Brusic et al. | 428/551 |
| 6,767,413 | B2 * | 7/2004 | Nishimura | 148/243 |
| 6,794,292 | B2 * | 9/2004 | Wu | 438/700 |
| 2001/0029104 | A1 * | 10/2001 | Aoki | 438/692 |
| 2002/0142622 | A1 * | 10/2002 | Iijima et al. | 438/768 |
| 2004/0089838 | A1 * | 5/2004 | Morikawa et al. | 252/2 |
| 2004/0099290 | A1 * | 5/2004 | Morinaga et al. | 134/27 |
| 2005/0287389 | A1 * | 12/2005 | Sugaya | 428/675 |
| 2007/0240734 | A1 * | 10/2007 | Teng et al. | 134/1 |

* cited by examiner

*Primary Examiner*—Sharidan Carillo
(74) *Attorney, Agent, or Firm*—Steven M. Reiss

(57) ABSTRACT

A surface treatment process for a metal article includes the following steps. Firstly, a metal article, made of at least one of copper and an alloy thereof, is provided. Secondly, a surface of the metal article is degreased. Thirdly, the surface of the metal article is activated in an acid solution. Finally, the surface of the metal article is deactivated by submersion in an antioxidant agent.

9 Claims, 1 Drawing Sheet

SURFACE TREATMENT PROCESS FOR METAL ARTICLES

BACKGROUND OF THE INVENTION

1. Field of the Invention

The present invention relates to surface treatment processes for copper articles and, particularly, to a surface treatment process for a metal article made of copper or an alloy thereof.

2. Description of Related Art

Metal articles made of beryllium-copper alloy, with a high-quality mechanical performance and a high conductivity, have tremendous applications in many industries.

During manufacture of the articles, some impurities or contaminants, e.g., oils or metal oxides, can be easily introduced onto surfaces of the articles, which may deteriorate the decorative appearance and/or the performance of the articles. Thus, the beryllium-copper alloy articles usually require a surface cleaning process for removing, e.g., the oil contaminants and/or metal oxide impurities.

The oil contaminants can be removed in a degreasing process, which is carried out in an alkaline cleaning agent, for example, sodium hydroxide or sodium carbonate. The metal oxide impurities can be removed in an acid cleaning process, which is carried out in an acid solution, such as nitric acid and/or sulfuric acid.

However, the surfaces of the articles can be prone to oxidation while being exposed to air, which may, for example, result in the formation of yellow stains on the surfaces.

Therefore, a surface treatment process for a metal article is desired in order to overcome the above-described shortcomings.

SUMMARY OF THE INVENTION

In one present embodiment thereof, a surface treatment process for a metal article is provided. In a first step of the surface treatment process, a metal article made of at least one of copper and an alloy thereof is provided. In a second step of the surface treatment process, a surface of the metal article is degreased. In a third step of the surface treatment process, the surface of the metal article is activated in an acid solution. Finally, the surface of the metal article is deactivated by submersion thereof into an antioxidant agent.

Other advantages and novel features will become more apparent from the following detailed description of at least one preferred embodiment when taken in conjunction with the accompanying drawings.

BRIEF DESCRIPTION OF THE DRAWINGS

Many aspects of the present surface treatment process for a metal article can be better understood with reference to the following drawing. The components in the drawing are not necessarily drawn to scale, the emphasis instead being placed upon clearly illustrating the principles of the surface treatment process for a metal article. Moreover, in the drawing, like reference numerals designate corresponding parts throughout the several views.

DETAILED DESCRIPTION OF THE INVENTION

Figure 1:
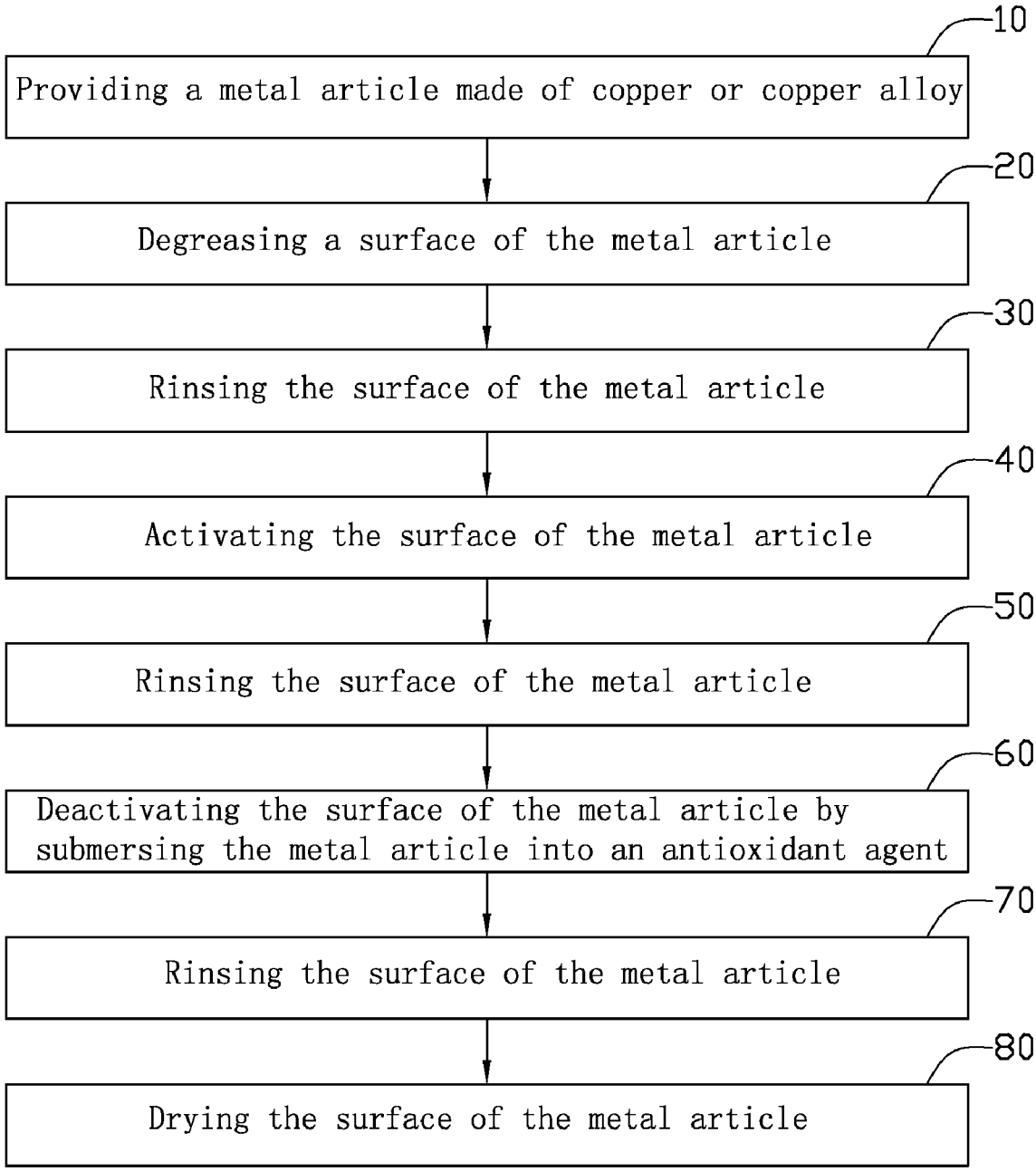
FIG. 1 is a flow chart of a surface treatment process for a metal article, in accordance with a present embodiment.

Referring to FIG. 1, in a present embodiment, a surface treatment process for a metal article includes the following steps:

step 10, providing a metal article made of copper or a copper alloy;

step 20, degreasing a surface of the metal article;

step 30, rinsing the surface of the metal article;

step 40, activating the surface of the metal article by an acid solution;

step 50, rinsing the surface of the metal article;

step 60, deactivating the surface of the metal article by submersing the metal article into an antioxidant agent;

step 70, rinsing the surface of the metal article; and step 80, drying the surface of the metal article.

In step 10, a metal article is provided. The metal article is fixed on a fixture member. The metal article is made of copper or an alloy thereof and, advantageously, is composed of a beryllium-copper alloy.

In step 20, a process for degreasing a surface of the metal article is carried out using, beneficially, an alkali-based cleaning solution so as to remove oil stains on the metal article. It is to be understood that the degreasing agent could include, alternatively or additionally, one or more surfactants and/or other agents known to promote degreasing.

In step 30, after being degreased, the surface of the metal article is subsequently rinsed, e.g., in running water or in an ultrasonically-vibrated water bath, so as to remove the residual of the alkali-based cleaning solution.

In step 40, the surface of the metal article is activated by submersing such into an acid cleaning solution so as to remove metal oxide impurities from the surface of the metal article. The acid cleaning solution may, opportunely, be a mixture of sulfuric acid and hydrogen peroxide, a mixture of nitric acid and acetic acid, or a mixture of phosphoric acid and acetic acid.

In step 50, the metal article is subsequently rinsed, for example, in running water or an ultrasonic water bath, so as to remove the residual of the acid cleaning solution.

In step 60, the surface of the metal article is deactivated by submersion thereof into, usefully, a benzotriazole antioxidant agent approximately for 3 minutes to 10 minutes. The benzotriazole antioxidant agent rather appropriately is a mixture including a composition of benzotriazole in an approximate amount of 0.09 wt % (percent by weight) to 0.12 wt %, a composition of sodium benzoate in an approximate amount of 0.03 wt % to 0.04 wt %, a composition of triethanolamine in an approximate amount of 0.06 wt % to 0.07 wt %, a composition of alcohol in an approximate amount of 0.07 wt % to 0.1 wt %, and water. An organic Cu-benzotriazole complex layer is thereby formed on the surface of the metal article. This complex layer appears as a plane, is well adhered thereto, and has a homogeneous metallic luster. More importantly, this complex layer could effectively reduce the opportunity for any further corrosion and/or oxidation of the surface of the metal article. It is to be understood that, alternatively, an organophosphorus oxidant, could, for example, be employed in step 60. The organophosphorus oxidant, beneficially, includes a composition of isopropyl phenyl diphenyl phosphate in an approximate amount of 6 wt % to 10 wt %, a composition of 5-hydroxy-2-pentanone in an approximate amount of 8.25 wt % to 10.75 wt %, and water. Some surfactant agents or other additive agents, for example, sodium lauryl ether sulfate of approximately 6.5 wt % to 8.5 wt %, diethylene glycol of approximately 8.75 wt % to 10.5 wt %, sodium dodecyl sulfate approximately less than 7.5 wt %, and/or 2,3-dichloro-2-propanol approximately less than 11 wt % could be added into the organophosphorus anti-oxidant. The organophosphorus anti-oxidant also yields a Cu-organic complex layer on the metal article, with the same general benefits as those of the Cu-benzotriazole complex layer (i.e., generically, a Cu-organic complex layer).

In step 70, the metal article is submersed into water to remove the antioxidant agent (i.e., the unreacted/excess portion) from the surface of the metal article.

In step 80, the metal article, advantageously, is dried with a high-pressure blower and subsequently roasted in an oven.

It should be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A surface treatment process for a metal article, comprising the steps of:

providing a metal article made of at least one of copper and a copper alloy;

degreasing a surface of the metal article;

removing metal oxide impurities from the degreased surface of the metal article by contacting said metal article with an acid solution; and forming a Cu-organic complex layer on the surface of the metal article by using an antioxidant agent;

wherein the antioxidant agent includes benzotriazole in an approximate amount of 0.09 wt % to 0.12 wt %, sodium benzoate in an approximate amount of 0.03 wt % to 0.04 wt %, triethanolamine in an approximate amount of 0.06 wt % to 0.07 wt %, an alcohol in an approximate amount of 0.07 wt % to 0.1 wt %, and water.

2. The surface treatment process as claimed in claim 1, wherein the step of degreasing the surface of the metal article is carried out using an alkali-based cleaning solution.

3. The surface treatment process as claimed in claim 1, further comprising a first rinsing process employing one of running water and an ultrasonically-vibrated water bath, the first rinsing process thereby cleaning the metal article after the step of degreasing the surface of the metal article.

4. The surface treatment process as claimed in claim 1, wherein the acid solution used in the step of removing metal oxide impurities from the degreased surface is selected from the group consisting of a mixture of sulfuric acid solution and hydrogen peroxide solution, a mixture of nitric acid solution and acetic acid solution, and a mixture of phosphoric acid solution and acetic acid solution.

5. The surface treatment process as claimed in claim 1, further comprising a second rinsing process employing one of running water and an ultrasonically-vibrated water bath, the second rinsing process thereby cleaning the metal article after the step of removing metal oxide impurities from the degreased surface of the metal article.

6. The surface treatment process as claimed in claim 1, further comprising a third rinsing process using water in order to clean the metal article after the step of forming the Cu-organic complex layer on the surface of the metal article.

7. The surface treatment process as claimed in claim 6, further comprising a drying process after the third rinsing process.

8. A surface treatment process for a metal article, comprising the steps of:

providing a metal article made of at least one of copper and a copper alloy;

degreasing a surface of the metal article;

removing metal oxide impurities from the degreased surface of the metal article by contacting the metal article with an acid solution; and forming a Cu-organic complex layer on the surface of the metal article by using an antioxidant agent;

wherein the antioxidant agent includes isopropyl phenyl diphenyl phosphate in an approximate amount of 6 wt % to 10 wt %, 5-hydroxy-2-pentanone in an approximate amount of 8.25 wt % to 10.75 wt %, and water.

9. The surface treatment process as claimed in claim 8, wherein the antioxidant agent further includes at least one of sodium lauryl ether sulfate of approximately 6.5 wt % to 8.5 wt %, diethylene glycol of approximately 8.75 wt % to 10.5 wt %, sodium dodecyl sulfate of approximately less than 7.5 wt %, and 2,3-dichloro-2-propanol of approximately less than 11 wt %.

* * * * *